US012650117B2

(12) United States Patent
Golde et al.

(10) Patent No.: US 12,650,117 B2
(45) Date of Patent: Jun. 9, 2026

(54) METHOD WITH A HYDRAULIC PRESSURE MEDIUM SUPPLY ARRANGEMENT, AND HYDRAULIC PRESSURE MEDIUM SUPPLY ARRANGEMENT

(71) Applicant: Robert Bosch GmbH, Stuttgart (DE)

(72) Inventors: Marcel Golde, Laupheim (DE); Ximing Wang, Neu-Ulm (DE); Salih Tetik, Nersingen (DE); Michael Brand, Ulm (DE); Daniel Geiger, Ulm (DE); Benedikt Schrodi, Schemmerhofen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/727,095

(22) PCT Filed: Jan. 10, 2023

(86) PCT No.: PCT/EP2023/050394
§ 371 (c)(1),
(2) Date: Jul. 7, 2024

(87) PCT Pub. No.: WO2023/135112
PCT Pub. Date: Jul. 20, 2023

(65) Prior Publication Data

US 2025/0172131 A1 May 29, 2025

(30) Foreign Application Priority Data

Jan. 14, 2022 (DE) ..... 10 2022 200 396.9

(51) Int. Cl.
*F04B 1/295* (2020.01)
*F04B 1/32* (2020.01)
(Continued)

(52) U.S. Cl.
CPC ..... *F04B 1/295* (2013.01); *F04B 1/32* (2013.01); *F04B 1/324* (2013.01); *F04B 49/002* (2013.01); *F04B 49/065* (2013.01)

(58) Field of Classification Search
CPC .. F04B 1/295; F04B 1/32; F04B 1/324; F04B 49/002; F04B 49/065
See application file for complete search history.

(56) References Cited

U.S. PATENT DOCUMENTS 3,750,534 A * 8/1973 Leutner ..... F04B 49/08 91/506
6,305,163 B1 * 10/2001 Paakkunainen ..... F15B 11/165 60/452
(Continued)

FOREIGN PATENT DOCUMENTS

DE 100 06 977 A1 9/2001
DE 10 2013 113 205 A1 5/2015
(Continued)

OTHER PUBLICATIONS

International Search Report corresponding to PCT Application No. PCT/EP2023/050394, mailed Mar. 15, 2023 (German and English language document) (6 pages).

*Primary Examiner* — Dustin T Nguyen
(74) *Attorney, Agent, or Firm* — Maginot, Moore & Beck LLP

(57) ABSTRACT

A method with a hydraulic pressure medium supply arrangement for an open hydraulic circuit having a hydraulic machine, an adjusting mechanism, and an electronic control unit is disclosed. The method includes the steps of reading an actual value and a setpoint value associated therewith for hydraulic operating variables of the hydraulic machine into a first outer control loop and determining the first manipulated variables resulting therefrom. In further steps of the method, the actual values and further setpoint values of the
(Continued)

hydraulic operating variables are read into a second outer control loop, compared with one another, and, on the basis thereof, at least one second manipulated variable is determined. Depending on the first and second manipulated variables, a setpoint adjustment speed is then determined as a manipulated variable for the adjusting mechanism. A hydraulic pressure medium supply arrangement which is designed to carry out the above method is also disclosed.

19 Claims, 5 Drawing Sheets

(51) Int. Cl.

| | |
|---|---|
| ***F04B 1/324*** | (2020.01) |
| ***F04B 49/00*** | (2006.01) |
| ***F04B 49/06*** | (2006.01) |

(56) References Cited

U.S. PATENT DOCUMENTS

| | | | | |
|---|---|---|---|---|
| 8,499,552 | B2 * | 8/2013 | Kauss | F15B 11/003 60/461 |
| 2021/0025374 | A1 * | 1/2021 | Muehlbauer | F04B 1/295 |

FOREIGN PATENT DOCUMENTS

| | | | |
|---|---|---|---|
| DE | 10 2015 223 122 | A1 | 5/2017 |
| DE | 10 2015 223 123 | A1 | 5/2017 |
| DE | 10 2016 201 588 | A1 | 8/2017 |
| DE | 10 2019 212 845 | A1 | 1/2021 |
| EP | 0 041 273 | A1 | 12/1981 |
| EP | 3 770 428 | A1 | 1/2021 |
| JP | 2014-15903 | A | 1/2014 |

* cited by examiner

METHOD WITH A HYDRAULIC PRESSURE MEDIUM SUPPLY ARRANGEMENT, AND HYDRAULIC PRESSURE MEDIUM SUPPLY ARRANGEMENT

This application is a 35 U.S.C. § 371 National Stage Application of PCT/EP2023/050394, filed on Jan. 10, 2023, which claims the benefit of priority to Serial No. DE 10 2022 200 396.9, filed on Jan. 14, 2022 in Germany, the disclosures of which are incorporated herein by reference in their entirety.

The disclosure relates to a method with a hydraulic pressure medium supply arrangement for an open hydraulic circuit and a hydraulic pressure medium supply arrangement.

BACKGROUND

A hydraulic pressure medium supply arrangement with an adjustable axial piston machine is known from the document EP 3 770 428 A1 from Rexroth. An adjustment cylinder is controlled by a control device, which comprises a cascaded control loop from an outer control loop and an inner control loop. The outer control loop forms manipulated variables as a function of setpoint and actual values, in particular of a working pressure, a pivot angle or delivery volume and a torque, of the axial piston machine. Prioritizing the smallest of these manipulated variables via a minimum value generator then sets the variable to be adjusted, which is at the upper limit compared to its setpoint value.

However, such a control does not offer the option of limiting a manipulated variable of the outer control loop downwards, in particular in the case of system-side limitations in the form of minimum limit values, as prioritization via the minimum value generator only results in an upper limit for the manipulated variables. For example, there can be requirements for the pivot angle of a swashplate of an axial piston machine, such that the swashplate does not fall below a minimum pivot angle and thus a predetermined minimum delivery or displacement volume of the axial piston machine. This ensures, among other things, that a minimum volume flow is always provided for a consumer. In the event that the actual working pressure of an axial piston machine is higher than a predetermined setpoint working pressure, although a predetermined minimum conveyance or displacement volume or a minimum pivot angle of the axial piston machine has already been reached, a pressure controller of the outer control loop would provide a negative manipulated variable value for the inner control loop and swivel in the axial piston machine to reduce the pressure. At the same time, a pivot angle controller of the outer control loop would output a positive value or zero to swing out the axial piston machine or hold the pivot angle so that the predetermined minimum pivot angle is not undershot. The generic prioritization of the smallest manipulated variable via a minimum value generator would thus select the working pressure as the control variable/variable to be controlled and consequently reduce the pivot angle even further below the predetermined minimum threshold value.

In contrast, the present disclosure is based on the task of providing a method with a hydraulic pressure medium supply arrangement by way of which a lower limitation/restriction of a hydraulic operating variable, preferably a pivot angle or a displacement volume, a working pressure, or a torque of a hydraulic machine in the form of an axial piston machine, is made possible. Furthermore, a hydraulic pressure medium supply arrangement is to be created that carries out this method.

The first of the problems is solved by a method having the features set forth below and the second by a hydraulic pressure medium supply arrangement having the features also set forth below. Advantageous configurations and further developments of the respective disclosure are matter additionally set forth below.

SUMMARY

The disclosure relates to a method with a hydraulic pressure medium supply arrangement for an open hydraulic circuit having a hydraulic machine, preferably an axial piston machine, with an adjusting mechanism which comprises an adjustment cylinder with an adjustment piston for adjusting a displacement volume/delivery volume or a pivot angle of the hydraulic machine and an electrically proportionally controllable (pilot) valve. The valve can be used to control an inflow into and/or an outflow from a control chamber of the adjustment cylinder limited by the adjustment piston. The valve is thereby controlled via an electronic control unit of the hydraulic pressure medium supply arrangement. The method includes the steps of reading a respective actual value and a setpoint value associated therewith of a displacement volume or a pivot angle of the hydraulic machine and/or a working pressure and/or a torque of the hydraulic machine, which can be determined therefrom, into a first outer control loop of the control unit and determining a first manipulated variable from a control deviation between the respective actual value and the setpoint value associated therewith via the control unit. The method includes the further steps of determining a setpoint adjustment speed of the displacement volume or pivot angle speed as a function of at least the first manipulated variable or first manipulated variables via the first outer control loop of the control unit. According to the disclosure, the method comprises the steps of reading a respective actual value and a setpoint value associated therewith of the displacement volume or pivot angle and/or the working pressure and/or the torque and determining at least one second manipulated variable from the respective actual value and the associated setpoint value via the control unit, such that the step of determining the setpoint adjustment speed also takes place as a function of the second manipulated variable or manipulated variables.

In other words, the electronic control unit of the hydraulic pressure medium supply arrangement has a first outer control loop for hydraulic control variables, preferably for the pivot angle or displacement volume/conveyance volume, the working pressure or the torque of a hydraulic machine, in particular an axial piston machine. This first outer control loop has the respective actual values of the hydraulic machine and the setpoint values associated as input variables. The first outer control loop determines the first control variables from the individual control deviations/control differences from the difference between the respective setpoint and actual values. In addition, the control unit preferably comprises a second outer control loop for the hydraulic operating variables. The second outer control loop comprises the respective actual values of the hydraulic machine and the specified/predetermined setpoint values associated therewith as input values. Preferably, these predetermined setpoint values are minimum limit values. The second outer control loop of the control unit determines second control variables from the control deviations of these input variables. Preferably, one of these manipulated variables of the two outer control loops is then fed to a subordinate inner control loop as a setpoint adjustment speed for the pivot angle or displacement volume of the hydraulic machine. The inner control loop also reads an actual adjustment speed as a derivation of the actual pivot angle or actual displacement volume of the hydraulic machine and carries out a comparison operation between the setpoint and actual adjustment speed. Preferably, the selection of the manipulated variable that is fed to the inner control loop is carried out via a selection unit.

This provides a method with a hydraulic pressure medium supply arrangement by means of which hydraulic operating variables of a hydraulic machine can be restricted/limited downwards in order to comply with corresponding minimum limit values, for example a minimum pressure or a minimum volume flow adjustable via the pivot angle, so that components of a pressure medium supply arrangement are operated in an allowable range.

In a further aspect of the disclosure, the at least one of the second manipulated variables represent a limitation of the working pressure as a function of a maximum allowable working pressure.

In an advantageous embodiment of the disclosure, a controller is downstream of the second outer control loop of the control unit and the step of limiting the working pressure as a function of the maximum allowable working pressure is carried out via this controller downstream of the second outer control loop. Alternatively, the controller for pressure cut-off is designed as the second outer control loop of the control unit and the method step of limiting the working pressure as a function of the maximum allowable working pressure is carried out as the second outer control loop via this controller.

In other words, the method has an (additional) pressure cut-off step. The corresponding controller is preferably upstream of a further minimum value generator, such that the pressure cut-off function in this embodiment of the electronic control unit has the highest priority. Thus, this arrangement is comparable to a lowest control axis of a hydro-mechanical controller. The controller for pressure cut-off is preferably provided with a separate parameterization and a setpoint value specification in order to enable different dynamics and setpoint values compared to the working pressure controller in the first outer control loop. Accordingly, the pressure control dynamics and the pressure cut-off specification as well as the pressure cut-off dynamics are decoupled and separately adjustable from one another.

In a further aspect of the disclosure, the method comprises a step of prioritizing a smallest of the first manipulated variables via a minimum value generator of the control unit. The step of determining the setpoint adjustment speed is carried out at least as a function of the prioritized, smallest of the first manipulated variables.

In other words, the selection unit of the electronic control unit comprises a determination device, preferably in the form of a minimum value generator. This has the output variables of the first outer control loop in the form of the first manipulated variables as input variables. The minimal value generator then prioritizes/selects the manipulated variable with the smallest value as the setpoint adjustment speed. This selection automatically activates only one controller of the first outer control loop, which is associated with the control variable prioritized by the minimum value generator. Here, the leading control variable is the manipulated variable whose control deviation is the smallest, and either the pivot angle or the displacement volume, the working pressure or the torque is precisely adjusted, while the two other variables are below their predetermined setpoint value.

With the aid of this selection via the minimum value generator, the control variable whose actual value is at the upper limit compared to its associated setpoint value is ultimately controlled via the first outer control loop. For example, the control variable whose actual value is furthest above the corresponding setpoint value is prioritized, as the manipulated variable is therefore the smallest/most negative. An upper limitation of the hydraulic operating variables is thereby achieved.

In a further aspect of the disclosure, the at least one of the second manipulated variables represent a limitation of a minimum setpoint pivot angle and/or a minimum setpoint displacement volume and/or a minimum setpoint output pressure and/or a minimum setpoint torque.

In a further aspect of the disclosure, the method comprises a step of prioritizing a largest of the second manipulated variable(s) and the smallest of the first manipulated variables prioritized by the minimal value generator via a maximum value generator of the control unit. The step of determining the setpoint adjustment speed is then carried out as a function of the prioritized, largest variable.

In other words, the selection unit of the electronic control unit comprises a second determination device, preferably in the form of a maximum value generator. This has as input variables the smallest manipulated variable prioritized by the minimum value generator in the form of the setpoint adjustment speed from the first outer control loop and the manipulated variables from the second outer control loop. The maximum value generator prioritizes the manipulated variable with the largest value from these input variables and outputs the setpoint adjustment speed prioritized on the basis of this MAX selection as the output variable.

Based on the prioritization by the maximum value generator, the control variable that falls below an associated minimum setpoint value is always controlled in the electronic control unit. In the event that all actual sizes of the hydraulic operating variables are greater than the predetermined minimum setpoint values/limit values, the second outer control loop outputs the value less than zero for the manipulated variables of the control variables. A comparison is then made between the value less than or equal to zero and the manipulated variable prioritized by the minimum value generator from the first outer control loop and the maximum value generator then prioritizes the larger value. This achieves a lower limit of the hydraulic operating quantities of the hydraulic machine, as a control of the hydraulic operating variables that fall below a predetermined minimum setpoint value is prioritized. A pivoting behavior of a hydraulic pump is then defined by the parameterization of the controllers, for example.

In addition, a further selection unit can be connected upstream of the maximum value generator, which blocks the (output) manipulated variables of the second outer control loop or withholds them from the maximum value generator in the event that the manipulated variables of the second outer control loop assume maximum negative values for all control variables, i.e. if none of the minimum setpoint values have undershot. In such a case, the manipulated variable prioritized by the minimum value generator is always also prioritized by the downstream maximum value generator, as no control via the second outer control loop is necessary here.

In a further aspect of the disclosure, the method comprises a step of reading in an actual adjustment speed and the setpoint adjustment speed determined as a function of at least the first manipulated variable(s) in an internal control loop of the control unit subordinated to the first outer control loop.

In a further aspect of the disclosure, the method comprises a step of limiting the setpoint adjustment speed, which has been determined based on the output variables of both outer control loops, as a function of a predetermined maximum setpoint adjustment speed and/or a predetermined minimum setpoint adjustment speed via a controller of the control unit upstream of the inner control loop.

In other words, preferably an additional controller for a limitation/restriction/specification of the setpoint adjustment speed of the pivot angle or displacement volume of a hydraulic machine is downstream of the maximum value generator. In particular, the manipulated variable of the maximum value generator is limited by the additionally predetermined limitation of the adjustment speed upwards and/or downwards, which is preferably adjustable, in order to affect a control dynamics of the pressure medium supply arrangement and to limit the dynamics for the swiveling in and out. This limitation can be a positive or negative maximum of the adjustment speed, for example. The higher the setpoint adjustment speed, the faster the hydraulic machine can swivel out. The dynamics of the hydraulic machine can therefore be overridden externally, independently of a specification of the (first) outer control loop, or internally to protect the components. For example, a cavitation, and thus the slowing down of the hydraulic machine dynamics can be avoided, although a higher pivot angle adjustment speed is required in the system in order to adjust the operating variable more quickly.

In the event that the controllers of the (inner and/or outer) control loops described above and/or the upstream controller for setpoint adjustment speed limitation and/or the downstream controller for pressure cut-off have at least one controller with an I-portion, the method according to the disclosure preferably has a step of freezing or reducing the I-portion of the controller(s) with a non-prioritized manipulated variable.

In other words, the controllers of the electronic control unit are preferably designed as PID controllers, the I-portions of which are (partially) reset or frozen when the corresponding controller is not active, i.e. not prioritized by the minimum value generators or the maximum value generator, because another controller or another control variable is dominant. For this reason, after each prioritization step/prioritization process, a minimum or maximum value generator is used to indicate which controller is prioritized in addition to the value of the respective output variable/manipulated variable. Depending on this status message, the corresponding I-portions of the controllers are either activated or deactivated. This prevents a wind-up effect of a controller when prioritizing another controller/control function.

In a further aspect of the disclosure, in the event that the inner control loop has a control element with an I-portion which is pilot-controlled via a pilot value and whose manipulated variable is limited via a manipulated variable limiter, the method has a step of limiting the I-portion as a function of the pilot control value and the limitation by the manipulated variable limiter via an I-portion limiter.

In other words, in the event that the output variable of a controller with an I-portion, preferably the controller of the inner control loop, is composed of a pilot control/feedforward portion and a controller portion, and the output variable is additionally limited/restricted, the method limits the I-portion of the controller as a function of the pilot control portion, so that a limitation/restriction of the output variable at the (sum) output of the controller is maintained. The controller then only works in up to a saturation in total and has no absolute anti-wind-up limitation. For example, a limitation of the sum output of a piloted controller from pilot portion and (PID) controller portion can be given by a manipulated variable limit. Depending on an operating state of a hydraulic machine, a portion of the manipulated variable is piloted. The difference between the pilot fraction and the manipulated variable limit is thus still available to the (PID) controller. Accordingly, the I-portion of the controller is limited, such that the sum output is not greater than the specification of the manipulated variable limit. The limitation of the I-portion thus results in $$I_{Limit} = \text{Manipulated variable limit} - \text{pilot control portion}$$

or $$I_{Limit} = \text{Manipulated variable limit} - \text{pilot control portion } P - \text{portion.}$$

This ensures that the controller does not wind up and that there is no additional phase shift or time delay.

In a further aspect of the disclosure, the method comprises a step of determining a control signal for the valve as a function of a setpoint neutral signal value and an actual signal value via a current controller.

In other words, the output variable/manipulated variable of the inner control loop in the form of a current signal is summed up with a pilot control value of a pilot control device, whereby a neutral flow of the (pilot) valve of the hydraulic pressure medium supply arrangement is pilot-controlled. The resulting setpoint neutral signal value is compared with an actual signal value via a current controller, preferably in the form of a PID controller, whereby a subsequent manipulated variable/control signal is fed to the valve.

The disclosure further relates to a hydraulic pressure medium supply arrangement for an open hydraulic circuit having a hydraulic machine, an adjusting mechanism, which comprises an adjustment cylinder with an adjustment piston for adjusting a displacement volume or pivot angle of the hydraulic machine and an electrically proportionally controllable (pilot) valve, via which an inflow and/or an outflow is controllable in a control space of the adjustment cylinder limited by the adjustment piston, to apply pressure to the adjustment piston, and with an electronic control unit, which is signal connected to a displacement transducer, a pressure sensor and an actuator of the valve, and which is configured to carry out the method according to the disclosure.

BRIEF DESCRIPTION OF THE DRAWINGS

The present disclosure will be explained in more detail in the following using advantageous embodiments and with reference to the accompanying figures. The figures are merely schematic in nature and serve solely to understand the disclosure. It is noted that the features of the individual embodiments can be interchanged with one another and can occur in any combination. Shown are.

DETAILED DESCRIPTION

Figure 1:
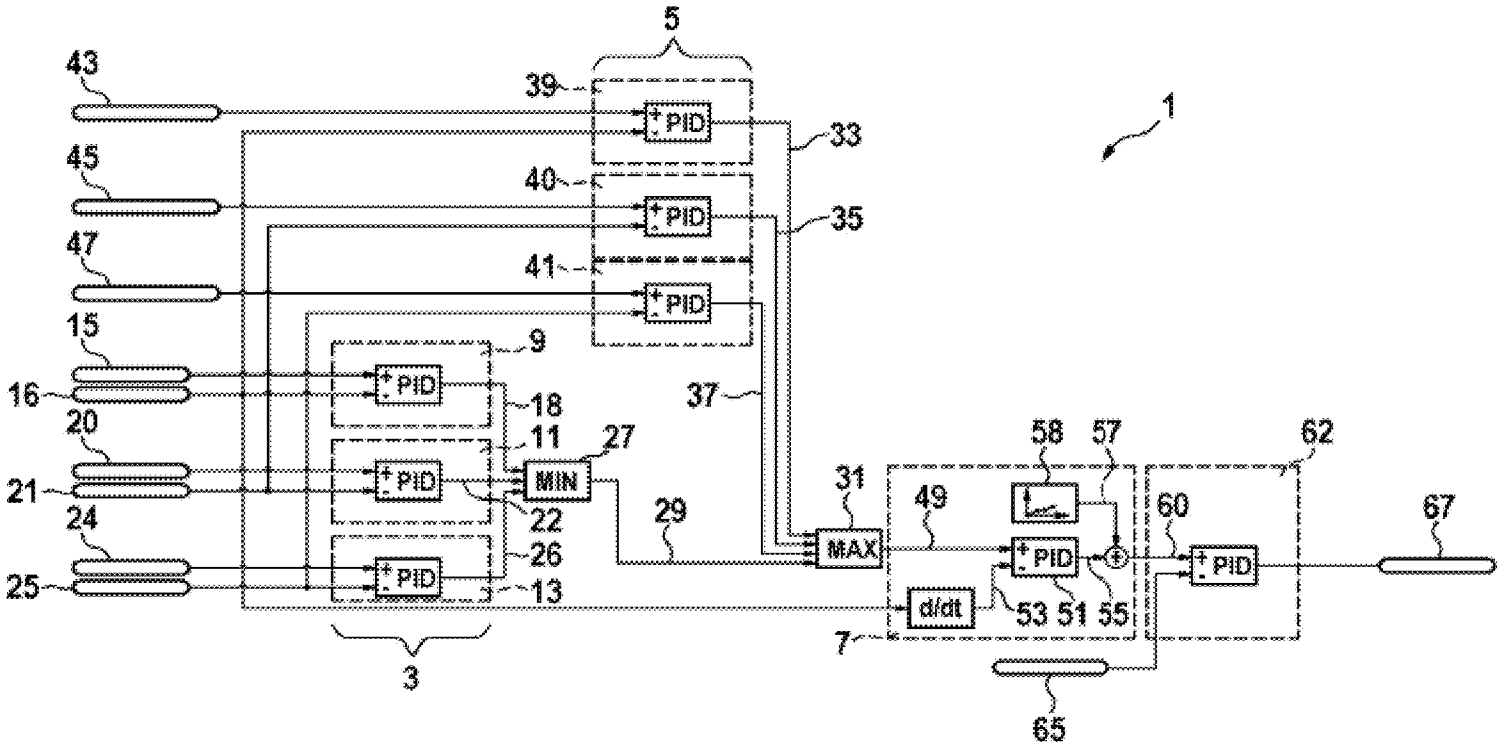
FIG. 1 an electronic control unit with input variables and output variables in a schematic representation, in accordance with a first embodiment example, FIG. 2 an electronic control unit from FIG. 1 with an additional control element for swivel speed limitation in a schematic representation, according to a second embodiment example, FIG. 3 an electronic control unit from FIG. 2 with an additional control element for pressure cut-off in a schematic representation, according to a third embodiment example, FIG. 4 a pilot-controlled PID regulator with a dynamically limited I-portion in a schematic representation, FIG. 5 a hydraulic pressure medium supply arrangement in a schematic representation with a hydraulic machine, with an adjusting mechanism and an electronic control unit.

FIG. 1 shows an electronic control unit 1 according to a first embodiment example with a first outer control loop 3, a second outer control loop 5 and an inner control loop 7. The first outer control loop 3 includes a controller 9 for a pivot angle of a hydraulic machine 10, preferably a swashplate of an axial piston machine, a controller 11 for a working pressure of the hydraulic machine 10, and a controller 13 for a torque of the hydraulic machine 10. The controller 9 has a setpoint pivot angle and the actual angle of the hydraulic machine 10 as input variables. A manipulated variable 18 forms the output variable of the controller 9. The controller 11 has a setpoint working pressure and the actual working pressure of the hydraulic machine 10 as input variables. A manipulated variable 22 is provided as the output variable of the controller 11. The controller 13 has a setpoint torque and the actual torque of the hydraulic machine 10 as input variables, whereas a manipulated variable 26 is the output variable of the controller 13. In this embodiment, the controllers 9,11,13 of the control unit 1 each have a control element in the form of a PID controller.

The three manipulated variables 18, 22, 26 of the first outer control loop 3 formed from control deviations between the setpoint and actual values are fed to a minimum value generator 27, which ensures that only the controller 9, 11 or 13 associated with the setpoint operating point is automatically active. Here, the leading control variable is the manipulated variable whose control deviation is the smallest, and either the pivot angle, the working pressure or the torque is precisely adjusted, while the two other variables are below their predetermined setpoint value. The output variable of the minimum value generator 27 forms a setpoint adjustment speed 29 of the pivot angle, which is fed as the input variable to a maximum value generator 31. The further input variables of the maximum value generator 31 are the output variables or manipulated variables 33, 35, 37 of the respective controllers 39, 40 and 41 of the second outer control loop 5. A minimum setpoint pivot angle 43 and the actual pivot angle 16 of the hydraulic machine 10 form the input variables of the controller 39. The controller 40 has a minimum setpoint working pressure 45 and the actual working pressure 21 of the hydraulic machine 10 as input variables, whereas the controller 41 has a minimum setpoint torque 47 and the actual torque of the hydraulic machine 10 as input variables. In this illustrated embodiment of the control unit 1, the controllers 39, 40 and 41 of the second outer control loop 5 are also designed in the form of PID control elements. The maximum value generator 31 ensures that only the controller 39, 40 or 41 of the second outer control loop 5 or the controller 9, 11 or 13 of the first outer control loop 3 prioritized by the minimum value generator 27 is active, which has the manipulated variable with the greatest control deviation. The output variable of the maximum value generator 31 is a setpoint adjustment speed 49 of the pivot angle, which is fed as the input variable to the inner control loop 7. The latter has a control element 51 in the form of a PID element. A further input variable for the control element 51 is an actual adjustment speed 53 of the pivot angle, which results from a time derivation of the actual pivot angle 16. The control element 51 of the inner control loop 7 has a manipulated variable 55 as an output variable in the form of a flow, which is summed up with a pilot control value 57 of a pilot control device 58, whereby a neutral flow of a valve 59 (compare with FIG. 5) is pilot-controlled. This pilot control results in a setpoint valve flow 60 for the valve 59, which is fed as the input variable to a flow controller 62 with a PID element. The flow controller 62 controls an actual valve flow 65 using the setpoint valve flow 60, whereby a control signal 67 is output for the valve 59.

Figure 2:
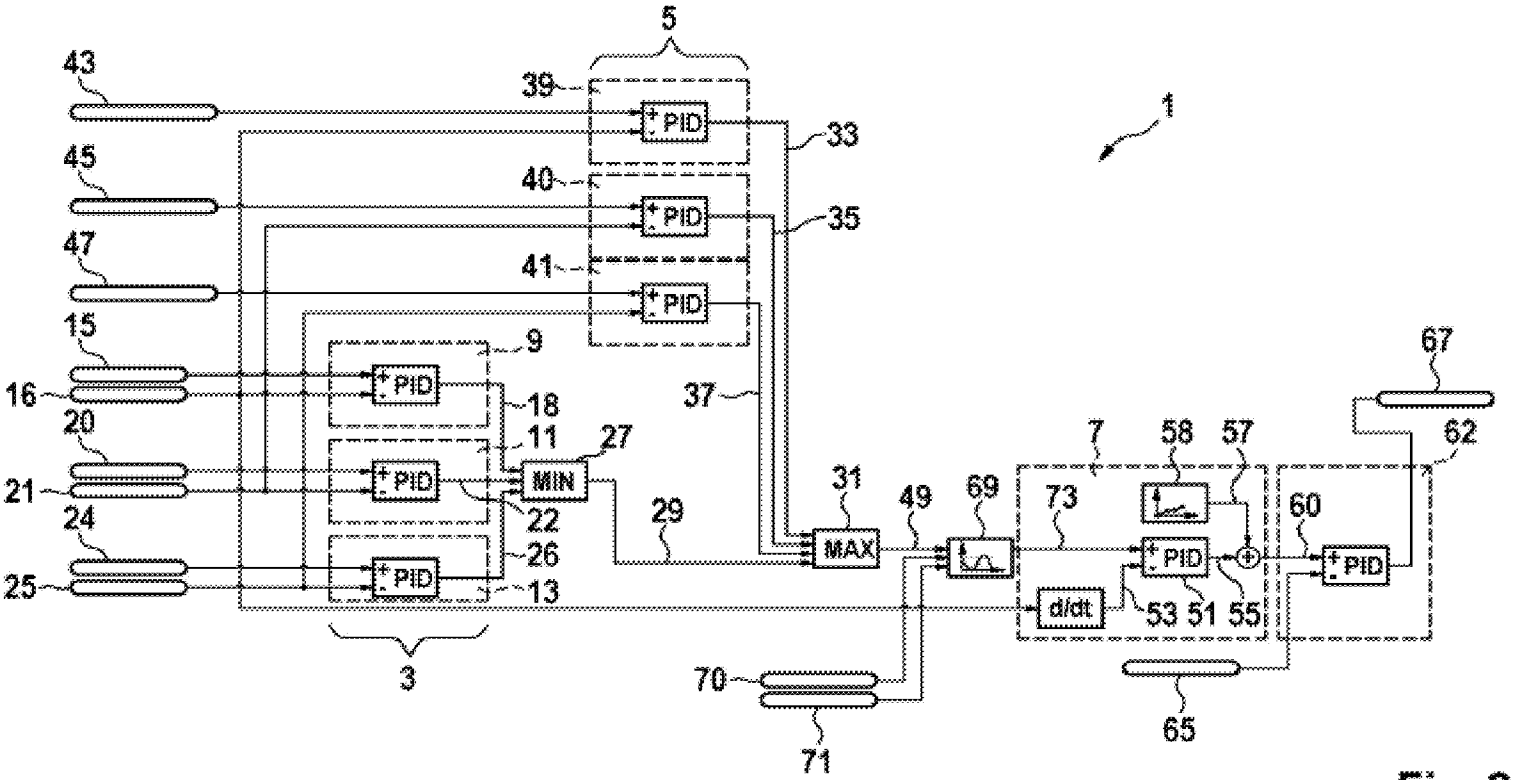

FIG. 2 shows the electronic control unit 1 according to a second embodiment example with the first outer control loop 3, the second outer control loop 5 and the inner control loop 7. This embodiment example of the electronic control unit 1 comprises all components of the electronic control unit 1 of the embodiment example illustrated in FIG. 1 as well as an additional extension by a control element 69 for adjustment speed limitation, whereby the setpoint adjustment speed 49 is additionally limited upwards as well as downwards. The control element 69 has the output variable of the maximum value generator 31 in the form of the setpoint adjustment speed 49, a maximum setpoint adjustment speed 70 and a minimum setpoint adjustment speed 71 as input variables. Any limited setpoint adjustment speed 73 forms the output variable of the control element 69 and the input variable of the inner control loop 7. The remaining control sequence of the electronic control unit 1 according to this second embodiment example, up to the output of the control signal 67, is carried out according to the first embodiment example of the electronic control unit 1 (see FIG. 1).

Figure 3:
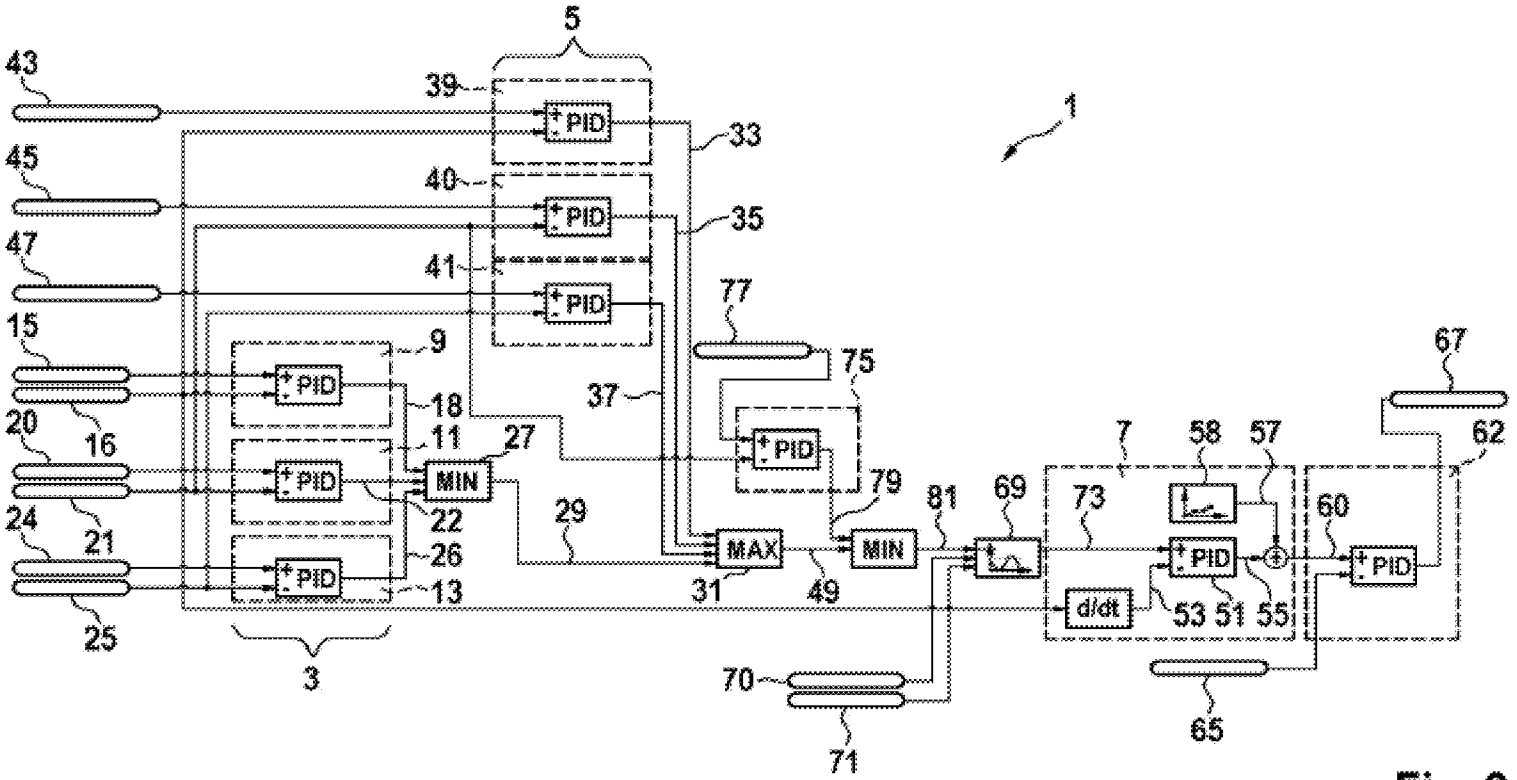

FIG. 3 shows the electronic control unit 1 according to a third embodiment example. This embodiment example of the electronic control unit 1 comprises all components of the electronic control unit 1 of the second embodiment example illustrated in FIG. 2 and is extended by an additional control element 75 with a pressure cut-off function, which separately regulates the actual working pressure 21 if the latter should exceed a predetermined maximum working pressure 77. The control element 75 has a setpoint value specification in the form of the maximum working pressure 77 and the actual working pressure 21 of the hydraulic machine 10 as input variables. In addition, the control element 75 is configured in the form of a PID member and has a setpoint adjustment speed 79 as output variable, which flows as the input variable into a second, inner minimum value generator 80. The output variable of the maximum value generator 31 in the form of the setpoint adjustment speed 49 forms the second input variable of the inner minimum value generator 80. The internal minimum value generator 80 prioritizes the smaller values of the setpoint adjustment speeds 49 and 79 as the manipulated variable and outputs the prioritized setpoint adjustment speed 81 as the output variable, which then flows into the control element 69 for adjustment speed limitation as an input variable (also compare FIG. 2). As a result of this arrangement, the control element 75 for pressure cut-off has the highest priority. The remaining control sequence of the electronic control unit 1 according to this third embodiment example, up to the output of the control signal 67, is carried out according to the second embodiment example of the electronic control unit 1 (see FIG. 2).

Figure 4:
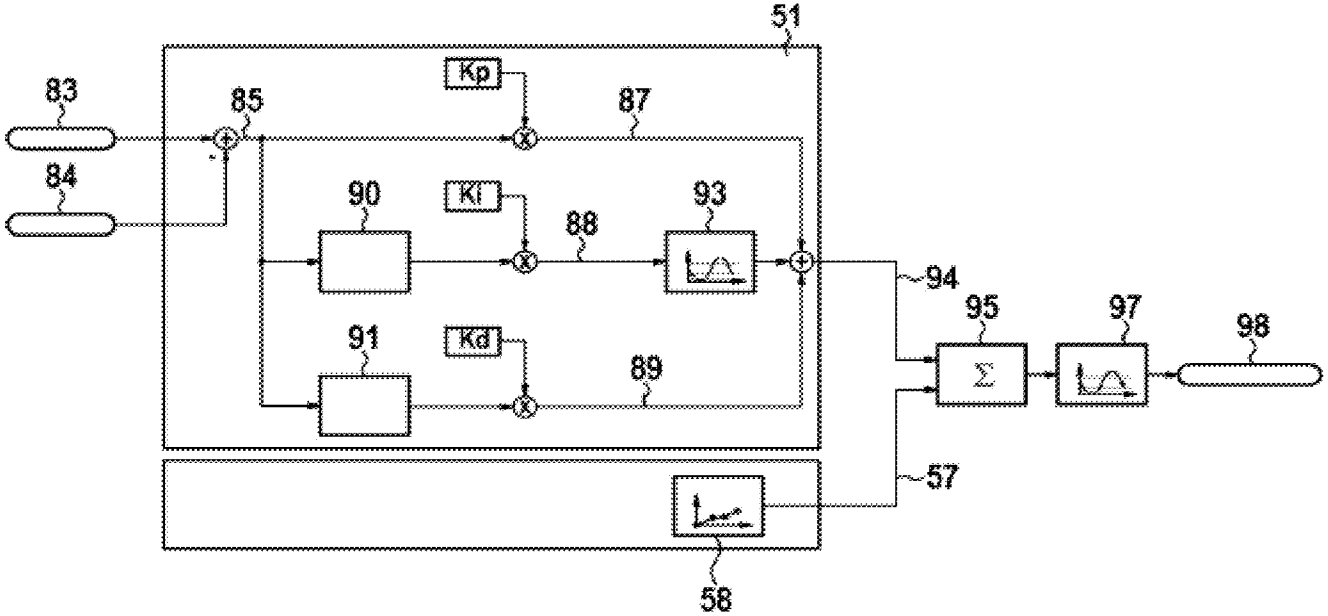

FIG. 4 shows a possible embodiment of the control element 51 of the inner control loop 7, which is pilot-controlled by the pilot control device 58. The control element 51 in the form of a PID regulator has a setpoint value 83 and an actual value 84 as input variables, the difference between which is used to calculate a control deviation 85. The control deviation 85 is divided into a P-portion 87, an I-portion 88 and a D-portion 89 by multiplying the control deviation 85 by a gain factor Kp, passing through an I-element 90 and then multiplying it by a gain factor Ki, or passing through a D-element 91 and then multiplying it by a gain factor Kd. In particular, the I-portion 88 passes through an I-portion limiter 93 and is then summed up with P-portions and D-portions 87 and 89, and the resulting manipulated variable 94 is then summed up with the pilot control value 57 of pilot control device 58 in a further summing block 95. The sum output from the pilot control value 57 and the manipulated variable 94 also passes through a manipulated variable limiter 97, which outputs the output value 98. The I-portion 88 of the control element 51 is limited as a function of the pilot control value 57 in such a way that the manipulated variable limit on the sum output is complied with. The I-portion 88 is thus dynamically limited as a function of the manipulated variable limit by the manipulated variable limiter 97 and the pilot control value 57.

Figure 5:
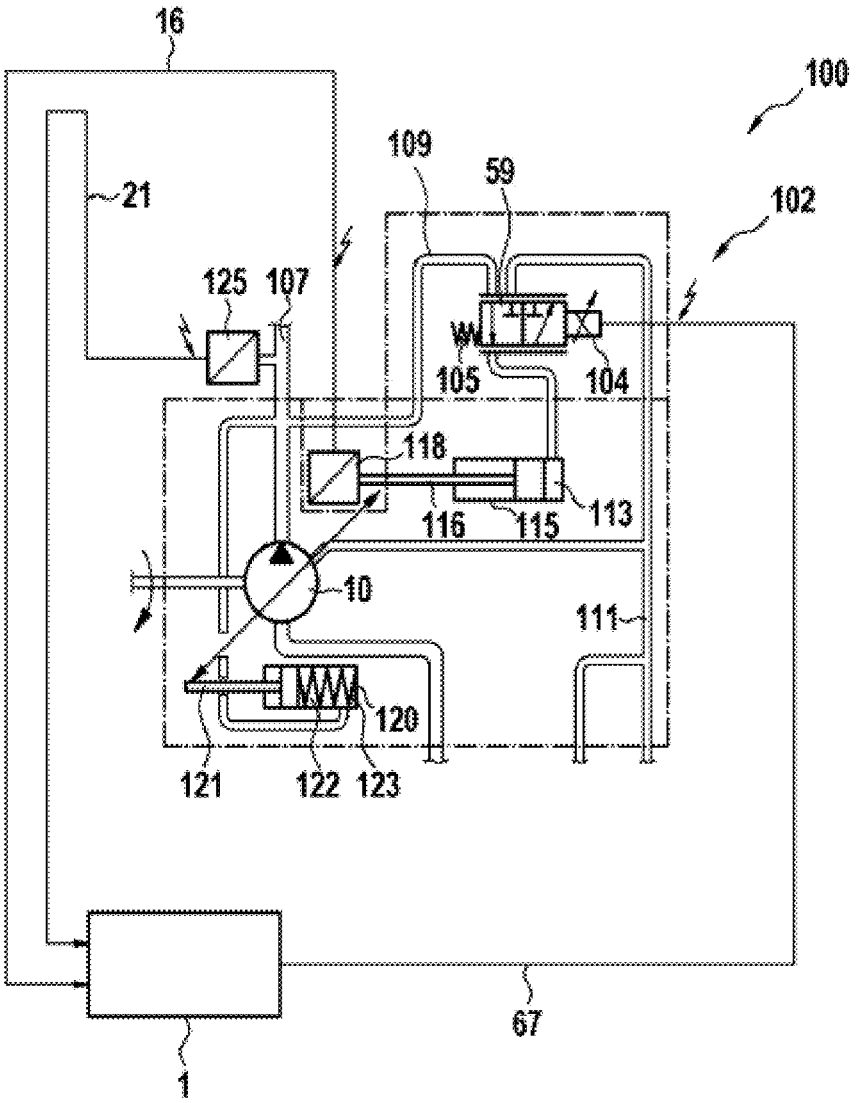

FIG. 5 shows a hydraulic pressure medium supply arrangement 100 having a hydraulic machine 10 in the form of an axial piston machine. This comprises a swivel cradle for adjusting a delivery volume. The hydraulic machine 10 can be used as a pump as well as a motor. An adjusting mechanism 102 is provided for the hydraulic machine 10. This has a valve 59. Its valve slider is electrically proportionally controllable via an actuator 104. For this purpose, the drive signal 67 is fed to the actuator 104 from the electronic control unit 1. The valve slider of the valve 59 is applied with a spring force of a valve spring 105 in the direction of a home position. The spring force acts against the actuator force of the actuator 104. The hydraulic machine 10 is connected on the output side to a pressure line 107, which in turn is connected to a main control valve or valve block not shown. A control line 109 branches off from the pressure line 107 and connects to a pressure connection of the valve 59. For example, the control line 109 is formed in a housing of the hydraulic machine 10. Furthermore, the valve 59 has a tank connection connected to a tank not shown via a tank line 111. In addition, the valve 59 has a work connection connected to a control chamber 113 of an adjustment cylinder 115. The control chamber 113 is thereby limited by an adjustment piston 116 of the adjustment cylinder 115. A swashplate of the axial piston machine or the hydraulic machine 10 can then be adjusted via the adjustment piston 116. A displacement of the adjustment piston 116 is sensed via a displacement transducer 118. Alternatively or additionally, a pivot angle of the swivel cradle of the axial piston machine or hydraulic machine 10 is tapped from a pivot axis of the swivel cradle via a rotary magnetic sensor. The actual delivery volume or the actual displacement volume or the actual pivot angle 16 of the hydraulic machine 10 can then be determined via the sensed path, which is reported to the electronic control unit 1.

Furthermore, the adjusting mechanism 102 includes a cylinder 120. This has an adjustment piston 121 that engages with the swashplate of the axial piston machine 10. The adjustment piston 121 limits a control chamber 122 connected to the pressure line 107. The adjustment piston 121 is acted upon by the pressure medium of the control chamber 122 and spring force of a spring 123, such that it loads the swashplate in the direction of increasing the delivery volume. Furthermore, a pressure sensor 125 is provided, via which the pressure in the pressure line 107 is tapped and reported to the controller 1, wherein the pressure is an actual working pressure 21.

When the pressure medium supply arrangement 100 is in use, the position of the swashplate of the axial piston machine 10 is controlled via the valve 59 and the adjustment piston 116. A conveyed volume flow of the axial piston machine 10 is proportional to the position of the swashplate. The actual working pressure or pump pressure is constantly applied to the adjustment piston 121 or counter-piston biased by the spring 123. When the axial piston machine 10 is not rotating and the adjusting mechanism 102 is depressurized, the swashplate is held in a +100 percent position by the spring 123. When the axial piston machine 10 is driven and the actuator 104 of the valve 59 is de-energized, the swashplate swivels to a zero stroke pressure, as the adjustment piston 116 is pressurized with the pressure medium of the pressure line 107. A balance between an actual working pressure at the adjustment piston 116 and the spring force of the spring 123 is established at a predetermined pressure or pressure range, for example between 8-12 bar. This zero stroke operation is assumed, for example, when the electronics or control unit 1 is de-energized. The valve 59 is controlled via the control unit 1, which is preferably a digital electronics unit, alternatively an analog electronics unit, for example. The control unit 1 processes the required control signals.

LIST OF REFERENCE NUMBERS

1 Electronic control unit
3 First outer control loop
5 Second outer control loop
7 Inner control loop
9, 11, 13 Controller of the first outer control loop
10 Hydraulic machine/axial piston machine
15 Setpoint pivot angle/setpoint displacement volume
16 Actual pivot angle/actual displacement volume
18, 22, 26 Variables of the first outer control loop
20 Setpoint working pressure
21 Actual working pressure
24 Setpoint torque
25 Actual torque
27 Minimum value generator
29 Setpoint adjustment speed of the first outer control loop
31 Maximum value generator
33, 35, 37 Manipulated variables of the second outer control loop
39, 40, 41 Controller of the second outer control loop
43 Minimum setpoint pivot angle/minimum setpoint displacement volume
45 Minimum setpoint output pressure
47 Minimum setpoint torque
49 Setpoint adjustment speed of the second outer control loop
51 Control element of the internal control loop
53 Actual adjustment speed
55 Manipulated value of the inner control loop
57 Pilot control value
58 Pilot control device
59 (Pilot) valve
60 Setpoint valve flow value
62 Flow controller
65 Actual valve flow value
67 Control signal
69 Controller for adjustment speed limitation

70 Maximum setpoint adjustment speed
71 Minimum setpoint adjustment speed
73 Limited setpoint adjustment speed
75 Controller for pressure cut-off
77 Maximum working pressure
79 Setpoint adjustment speed of the controller for pressure cut-off
80 Inner minimal value generator
81 Setpoint adjustment speed
83 Setpoint value
84 Actual value
85 Control deviation
87 P-portion
88 I-portion
89 D-portion
90 I-element
91 D-element
93 I-portion limiter
94 Manipulated variable
95 Sum block
97 Manipulated variable limiter
98 Output value
100 Hydraulic pressure medium supply arrangement
102 Adjusting mechanism
104 Actuator
105 Valve spring
107 Compression line
109 Control line
111 Tank line
113 Control chamber
115 Adjustment cylinder
116 Adjustment piston
118 Displacement transducer
120 Cylinder
121 Adjustment piston
122 Control chamber
123 Spring
125 Pressure sensor

The invention claimed is:

1. A method with a hydraulic pressure medium supply arrangement for an open hydraulic circuit having a hydraulic machine, with an adjusting mechanism, which comprises an adjustment cylinder with an adjustment piston for adjusting a displacement volume or pivot angle of the hydraulic machine and an electrically proportionally controllable valve, via which an inflow into and/or an outflow from a control chamber, delimited by the adjustment piston, of the adjustment cylinder can be controlled for adjustment, and with an electronic control unit for controlling the valve, the method comprising:

a) reading a respective actual value and a first setpoint value associated therewith, corresponding to one or more of a displacement volume or pivot angle of the hydraulic machine a working pressure and a torque of the hydraulic machine, into a first external control loop of the control unit;

b) determining a first manipulated variable from each respective actual value and first setpoint value associated therewith, via the control unit;

c) determining a setpoint adjustment speed as a function of at least one first manipulated variable, via the control unit;

d) reading the respective actual value and a second setpoint value associated therewith, corresponding to one or more of the displacement volume or pivot angle, the working pressure and the torque; and e) determining a second manipulated variable from each respective actual value and the associated second setpoint value, via the control unit, such that the step of determining the setpoint adjustment speed also takes place as a function of at least one second manipulated variable, wherein each second manipulated variable represents a limitation of one or more of a minimum setpoint pivot angle, a minimum setpoint displacement volume, a minimum setpoint output pressure and a minimum setpoint torque.

2. The method according to claim 1, wherein each second manipulated variable represents a limit of the working pressure as a function of a maximum allowable working pressure.

3. The method according to claim 1, further comprising:

prioritizing a smallest of each first manipulated variable via a minimum value generator of the control unit, wherein the step of determining the setpoint adjustment speed takes place at least as a function of the prioritized, smallest of each first manipulated variable.

4. The method according to claim 3, further comprising:

prioritizing a largest of each second manipulated variable and the prioritized, smallest of each first manipulated variable via a maximum value generator of the control unit, wherein the step of determining the setpoint adjustment speed takes place as a function of the prioritized, largest of each second manipulated variable.

5. The method according to claim 1, further comprising:

reading an actual adjustment speed and the setpoint adjustment speed determined in step c) into an inner control loop of the control unit subordinate to the first external control loop.

6. The method according to claim 5, further comprising:

limiting the setpoint adjustment speed as a function of a predetermined maximum setpoint adjustment speed and/or a predetermined minimum setpoint adjustment speed via a controller of the control unit upstream of the inner control loop.

7. The method according to claim 1, further comprising:

determining a control signal for the valve as a function of a setpoint valve flow value and an actual valve flow value via a flow controller.

8. A hydraulic pressure medium supply arrangement for an open hydraulic circuit, with a hydraulic machine with an adjusting mechanism, which comprises an adjustment cylinder with an adjustment piston for adjusting a displacement volume or pivot angle of the hydraulic machine and an electrically proportionally controllable valve, via which an inflow and/or an outflow is controllable in a control chamber of the adjustment cylinder limited by the adjustment piston, to apply pressure to the adjustment piston, and with an electronic control unit, which is signal connected to a displacement transducer, a pressure sensor and an actuator of the valve, and which is configured to carry out the method according to claim 1.

9. A method with a hydraulic pressure medium supply arrangement for an open hydraulic circuit having a hydraulic machine, with an adjusting mechanism, which comprises an adjustment cylinder with an adjustment piston for adjusting a displacement volume or pivot angle of the hydraulic machine and an electrically proportionally controllable valve, via which an inflow into and/or an outflow from a control chamber, delimited by the adjustment piston, of the adjustment cylinder can be controlled for adjustment, and with an electronic control unit for controlling the valve, the method comprising:

a) reading a respective actual value and a first setpoint value associated therewith, corresponding to one or more of a displacement volume or pivot angle of the hydraulic machine a working pressure and a torque of the hydraulic machine, into a first external control loop of the control unit;

b) determining a first manipulated variable from each respective actual value and first setpoint value associated therewith, via the control unit;

c) determining a setpoint adjustment speed as a function of at least one first manipulated variable, via the control unit;

d) reading the respective actual value and a second setpoint value associated therewith, corresponding to one or more of the displacement volume or pivot angle, the working pressure and the torque;

e) determining a second manipulated variable from each respective actual value and the associated second setpoint value, via the control unit, such that the step of determining the setpoint adjustment speed also takes place as a function of at least one second manipulated variable; and f) reading an actual adjustment speed and the setpoint adjustment speed determined in step c) into an inner control loop of the control unit subordinate to the first external control loop, wherein the inner control loop comprises a control element pilot-controlled via a pilot control value with an I-portion, the manipulated variable of which is limited via a manipulated variable limiter, further comprising:

limiting the I-portion as a function of the pilot control value and the restriction by the manipulated variable limiter via an I-portion limiter.

10. The method according to claim 9, wherein each second manipulated variable represents a limit of the working pressure as a function of a maximum allowable working pressure.

11. The method according to claim 9, further comprising:

prioritizing a smallest of each first manipulated variable via a minimum value generator of the control unit, wherein the step of determining the setpoint adjustment speed takes place at least as a function of the prioritized, smallest of each first manipulated variable.

12. The method according to claim 9, wherein each second manipulated variable represents a limitation of one or more of a minimum setpoint pivot angle, a minimum setpoint displacement volume, a minimum setpoint output pressure and a minimum setpoint torque.

13. The method according to claim 12, further comprising:

prioritizing a largest of each second manipulated variable and the prioritized, smallest of each first manipulated variable via a maximum value generator of the control unit, wherein the step of determining the setpoint adjustment speed takes place as a function of the prioritized, largest of each second manipulated variable.

14. The method according to claim 9, further comprising:

limiting the setpoint adjustment speed as a function of a predetermined maximum setpoint adjustment speed and/or a predetermined minimum setpoint adjustment speed via a controller of the control unit upstream of the inner control loop.

15. A method with a hydraulic pressure medium supply arrangement for an open hydraulic circuit having a hydraulic machine, with an adjusting mechanism, which comprises an adjustment cylinder with an adjustment piston for adjusting a displacement volume or pivot angle of the hydraulic machine and an electrically proportionally controllable valve, via which an inflow into and/or an outflow from a control chamber, delimited by the adjustment piston, of the adjustment cylinder can be controlled for adjustment, and with an electronic control unit for controlling the valve, the method comprising:

a) reading a respective actual value and a first setpoint value associated therewith, corresponding to a displacement volume or pivot angle of the hydraulic machine, a working pressure and a torque of the hydraulic machine, into a first external control loop of the control unit;

b) determining a first manipulated variable from each respective actual value and first setpoint value associated therewith, via the control unit;

c) reading the respective actual value and a second setpoint value associated therewith, corresponding to the displacement volume or pivot angle, the working pressure and the torque, into a second external control loop separate from said first external control loop, wherein each second setpoint value corresponding to each respective actual value is different from each first setpoint value corresponding to the respective actual value;

d) determining a second manipulated variable from each respective actual value and the associated second setpoint value, via the control unit and, e) determining a setpoint adjustment speed as a function of at least one first manipulated variable and at least one second manipulated variable, via the control unit.

16. The method according to claim 15, wherein each second manipulated variable represents a limit of the working pressure as a function of a maximum allowable working pressure.

17. The method according to claim 15, wherein each second manipulated variable represents a limitation of one or more of a minimum setpoint pivot angle, a minimum setpoint displacement volume, a minimum setpoint output pressure and a minimum setpoint torque.

18. The method according to claim 15, further comprising:

prioritizing a smallest of each first manipulated variable via a minimum value generator of the control unit, wherein the step of determining the setpoint adjustment speed takes place at least as a function of the prioritized, smallest of each first manipulated variable.

19. The method according to claim 18 further comprising:

prioritizing a largest of each second manipulated variable and the prioritized, smallest of each first manipulated variable via a maximum value generator of the control unit, wherein the step of determining the setpoint adjustment speed takes place as a function of the prioritized, largest of each second manipulated variable.

* * * * *